US006012936A

United States Patent [19]

Siemon et al.

[11] Patent Number: 6,012,936

[45] Date of Patent: Jan. 11, 2000

[54] SWITCHING JACK

[75] Inventors: John A. Siemon, Woodbury; Mark Viklund, New Milford, both of Conn.

[73] Assignee: The Siemon Company, Watertown, Conn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/732,040

[22] Filed: Oct. 16, 1996

[51] Int. Cl.[7] ..... H01R 29/00

[52] U.S. Cl. ..... 439/188; 439/676

[58] Field of Search ..... 439/188, 491, 439/676

[56] References Cited

U.S. PATENT DOCUMENTS

| | | | |
|---|---|---|---|
| 3,369,214 | 2/1968 | Krumreich et al. | 439/676 |
| 4,274,691 | 6/1981 | Abernathy et al. | 439/188 |
| 4,552,423 | 11/1985 | Swengel, Jr. | 439/188 |
| 4,778,410 | 10/1988 | Tanaka | 439/676 |
| 4,806,117 | 2/1989 | Johnston | 439/676 |
| 4,863,393 | 9/1989 | Ward et al. | 439/188 |
| 5,030,123 | 7/1991 | Silver | 439/188 |
| 5,074,801 | 12/1991 | Siemon | 439/188 |
| 5,178,554 | 1/1993 | Siemon | 439/188 |
| 5,217,190 | 6/1993 | Reed et al. | 248/27.3 |
| 5,425,660 | 6/1995 | Weikle | 439/676 |
| 5,620,335 | 4/1997 | Siemon | 439/491 |
| 5,624,274 | 4/1997 | Lin | 439/676 |
| 5,697,817 | 12/1997 | Bouchan et al. | 439/676 |
| 5,704,797 | 1/1998 | Meyerhoefer et al. | 439/188 |

*Primary Examiner*—Paula Bradley
*Assistant Examiner*—Tho D. Ta
*Attorney, Agent, or Firm*—Cantor Colburn LLP

[57] ABSTRACT

A switching jack for use with a circuit board. The switching jack includes a housing having a single opening for receiving a standard plug. Within the housing is a contact carrier which holds a plurality of resilient conductive pins. The resilient conductive pins extend angularly through an open area in the housing and extend out from the rear surface of the jack. When the jack is mounted to a circuit board the resilient conductive pins contact grooved contacts formed in the circuit board. The electrical connections between the resilient conductive pins and the grooved contacts is interrupted when a plug is placed in the jack.

5 Claims, 9 Drawing Sheets

SWITCHING JACK

BACKGROUND OF THE INVENTION

1. Field of the Invention

The invention relates generally to a modular jack and in particular to a modular jack having a single opening for receiving a standard modular plug which, when inserted in the jack, disconnects conductive pins from a circuit board.

2. Prior Art

Modular jack patching devices are known in the art as exhibited by U.S. Pat. No. 5,074,801. Referring to FIG. 1, the '801 patent describes a modular jack patching device having a pair of oppositely disposed openings 2 and 4 for receiving standard modular plugs. A circuit board 6 is clipped to the back side of the housing, as shown in FIG. 2, for establishing an electrical connection between resilient conductive pins 8 positioned in the openings 2 and 4. Resilient conductive pins 8 normally establish an electrical connection with the circuit board 6. When a plug is inserted in the opening 2 or 4, the pins 8 are deflected away from the circuit board 6 and the electrical connection between the resilient conductive pins 8 and the circuit board 6 is broken. U.S. Pat. No. 5,178,554 discloses a similar modular jack patching device.

Although the modular jack patching devices of U.S. Pat. Nos. 5,074,801 and 5,178,554 are well suited for their intended purposes, there are difficulties using these modular jacks in a variety of applications. The size of the dual opening modular jack makes it difficult to use the jack with existing systems. In addition, certain applications only require a single jack in which the dual opening modular jack of the prior art is unnecessary.

SUMMARY OF THE INVENTION

The above-discussed and other drawbacks and deficiencies of the prior art are overcome or alleviated by the switching jack of the present invention. The switching jack of the present invention includes a housing having a single opening for receiving a plug. Within the housing is a contact carrier which holds a plurality of resilient conductive pins. The resilient conductive pins extend angularly through an open area in the housing an extend out from the rear surface of the jack. When the jack is mounted to a circuit board, the resilient conductive pins contact grooved contacts formed in the circuit board. When a plug is inserted in the jack, the electrical connections between the resilient conductive pins and the grooved contacts is interrupted. In an alternative embodiment, the housing includes an opening for receiving an icon.

The housing only has a single opening and thus has a smaller size than prior switching jacks. Accordingly, the switching jack of the present invention can be used in applications not suitable for the larger, dual-opening switching jacks.

The above-discussed and other features and advantages of the present invention will be appreciated and understood by those skilled in the art from the following detailed description and drawings.

BRIEF DESCRIPTION OF THE DRAWINGS

Referring now to the drawings wherein like elements are numbered alike in the several FIGURES.

DETAILED DESCRIPTION OF THE INVENTION

Figure 1:
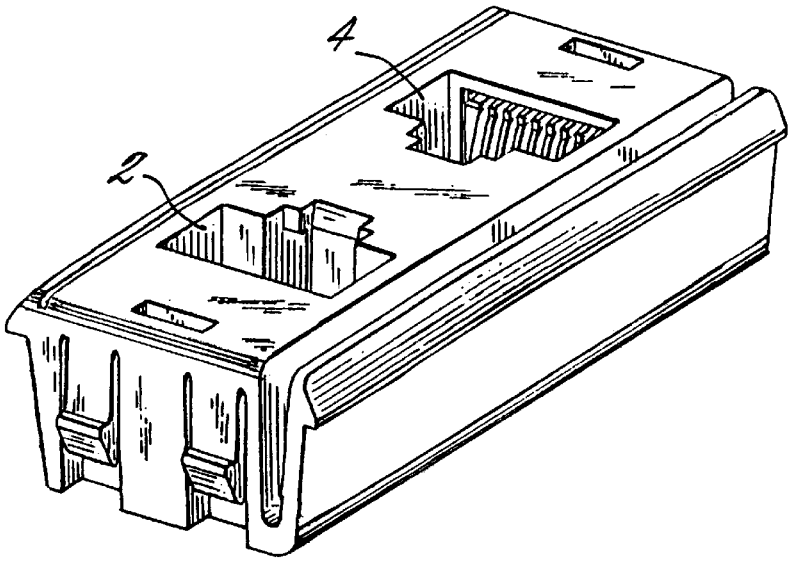
FIG. 1 (PRIOR ART)
FIG. 1 is a perspective view of the conventional dual opening modular jack.
Figure 2:
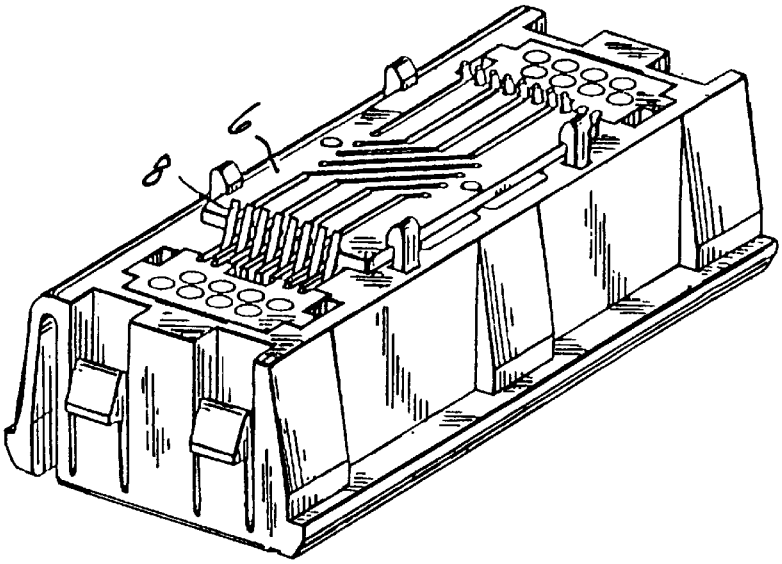
FIG. 2 (PRIOR ART)
FIG. 2 is an alternative perspective view of the conventional dual opening modular jack.
Figure 3:
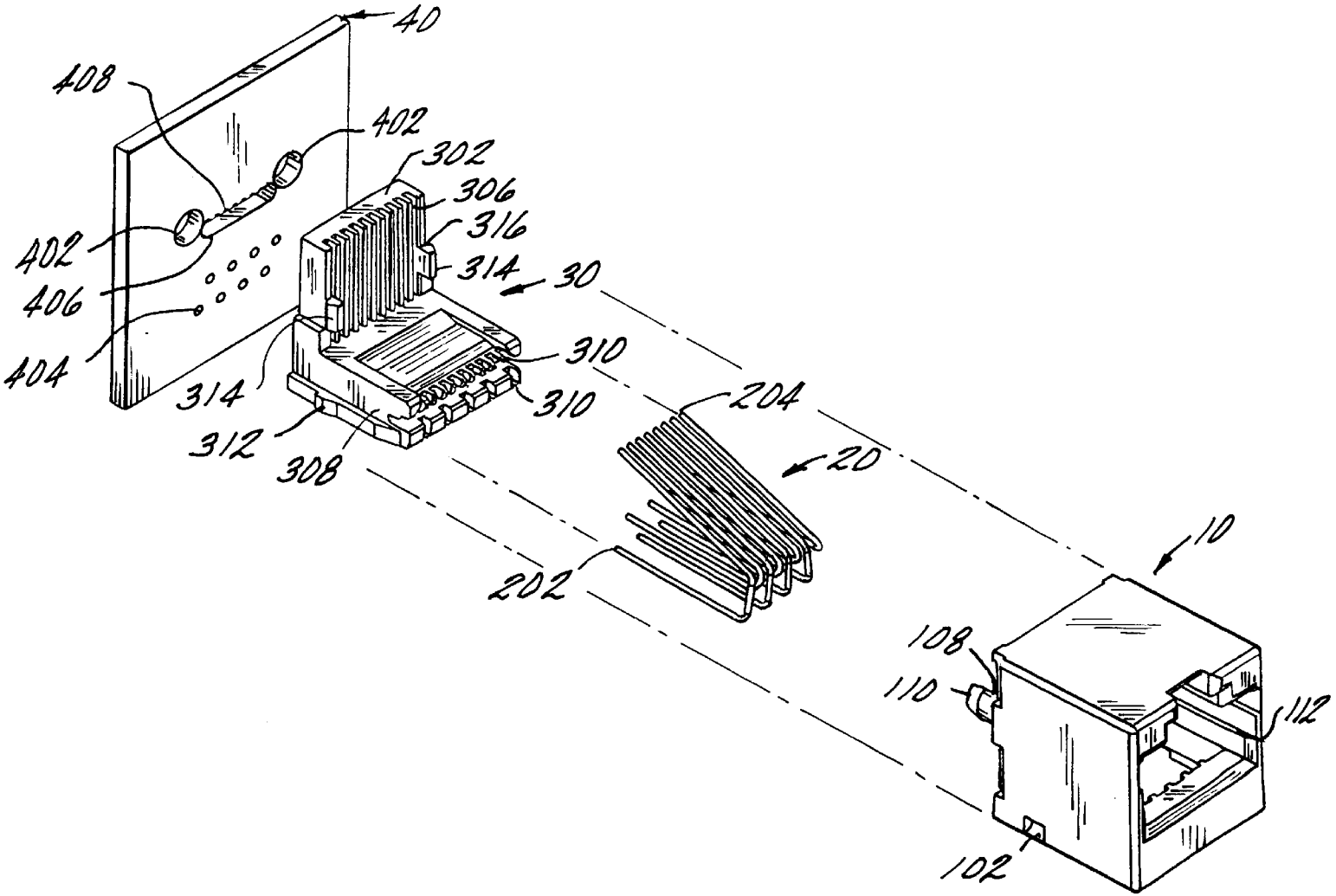
FIG. 3 is an exploded view of the switching jack of the present invention and a circuit board.
Figure 4:
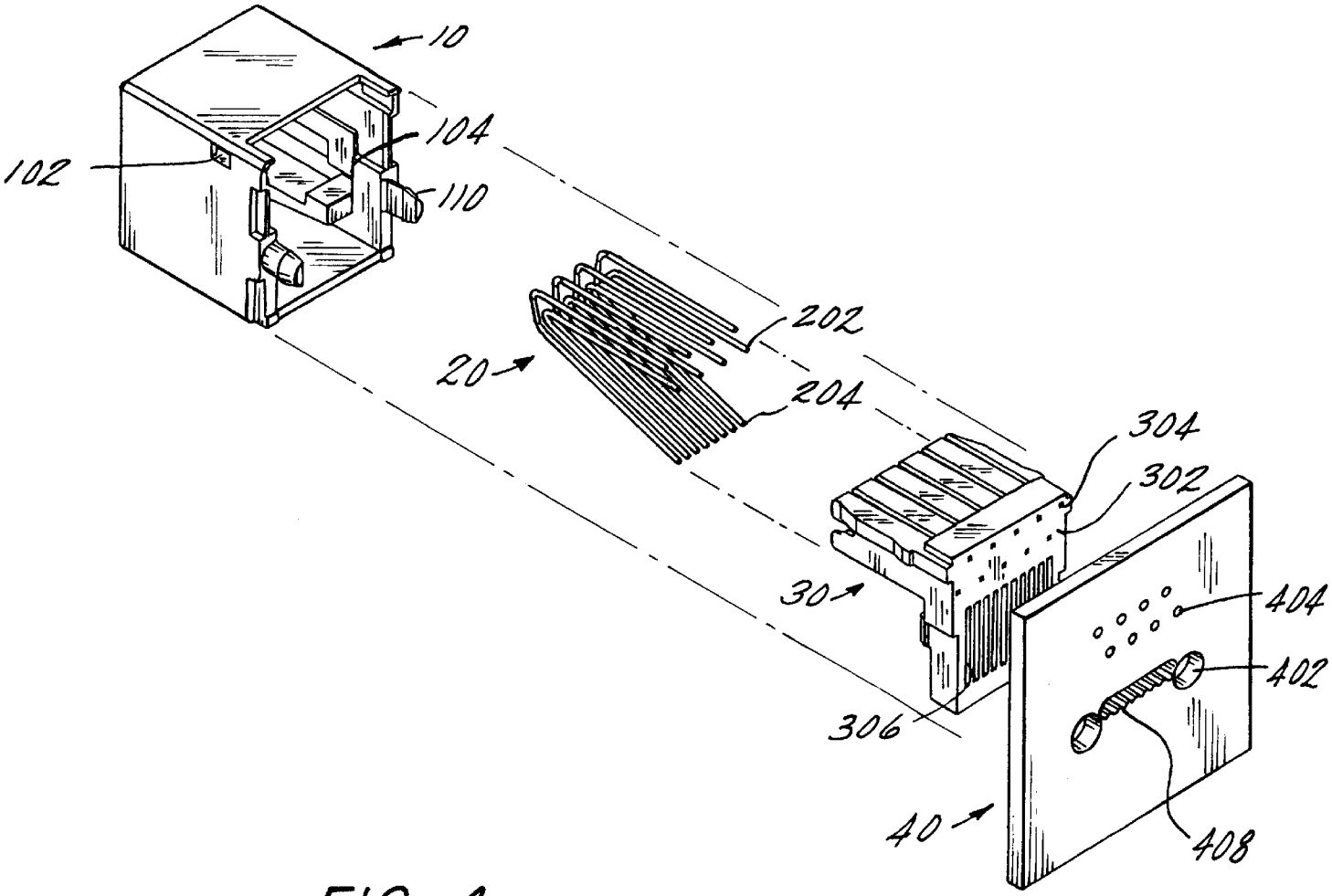
FIG. 4 is an alternative exploded view of the switching jack of the present invention and a circuit board.

FIG. 3 is an exploded view of the switching jack, made up of housing 10, resilient conductive pins 20 and a contact holder 30, and a circuit board 40. To assemble the switching jack, the conductive pins 20 are first mounted to the contact carrier 30. The rear section 302 of the contact carrier 30 includes a plurality of holes 304 and slots 306 shown in FIG. 4. The rear section 302 forms the rear face of the switching jack when connected to the housing. A first end 202 of each of the conductive pins 20 extends through the holes 304 in the contact carrier 30. A second end 204 of each of the conductive pins 20 extends through the slots 306. A bottom section 308 of the contact carrier 30 includes a front lip having a plurality of notches 310 for receiving a portion of the conductive pins 20. The notches 310 keep the conductive pins 20 separated and maintain the proper separation between the individual conductive pins 20. Although eight conductive pins 20 are shown in FIG. 3, it is understood that pin configurations such as two, four, six, and ten may be used in the switching jack.

Once the conductive pins 20 are mounted to the contact carrier 30, the housing 10 is then snapped on to the contact carrier 30. In an exemplary embodiment, both the contact carrier 30 and the housing 10 are made from a resilient plastic which allows the contact carrier 30 to be connected to the housing 10 without damage to the housing or contact carrier. A pair of tabs 312 formed on the periphery of the bottom section 308 of the contact carrier 30 engage a pair of slots 102 formed in side walls of the housing 10. In addition, two fingers 314, having a recess 316, engage two ribs 104 formed on the inside of the side walls of the housing. The ribs 104 are positioned with the recesses 316. The interference fit between the ribs 104 and the recesses 316 and the tabs 312 and slots 102 connect the contact carrier 30 to the housing 10. The assembled housing 10, conductive pins 20 and contact carrier 30 forms the switching jack.

The switching jack is then mounted to a circuit board 40 to form a patching module for performing various operations depending on the specifics of the circuit board 40. The housing 10 includes a pair of tabs 106 having a neck 108 and a head 110 having a half conical shape. The neck 106 has an outer dimension that is smaller than the base of the head 110. The circuit board 40 includes holes 402 for receiving the tabs 106. The lip between the head 110 and the neck 108 engages the circuit board 40. The interference fit between the head 110 and the circuit board 40 connects the switching jack to the circuit board. The circuit board 40 includes holes 404 that receive the first end 202 of the conductive pins 20. An elongated aperture 406 is formed in the circuit board 40. Within the aperture 406 are contact grooves 408 that receive the second end 204 of the conductive pins. The first end 202 of the conductive pins 20 is permanently attached to the circuit board 40 by soldering. The contact between the second end 204 of the conductive pins 20 and the contact grooves 408 is broken when a plug is inserted in an opening 112 formed in the housing 10. The opening 112 is substantially parallel to the surface of the contact carrier 30 that the first ends 202 extend through.

Figure 5:
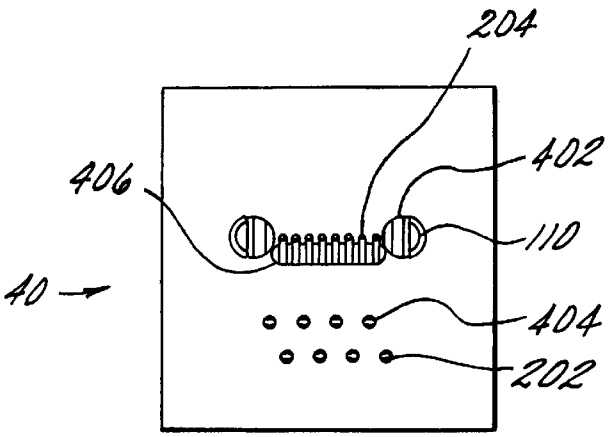
FIG. 5 is a rear view of the switching jack mounted to a circuit board.
Figure 9:
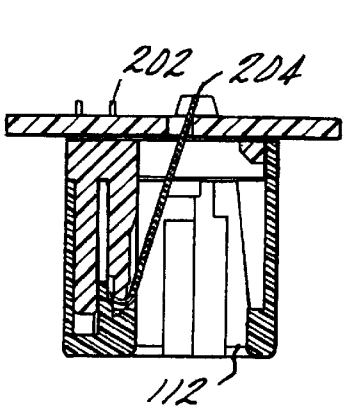
FIG. 9 is a cross sectional view taken along line 9—9 of FIG. 7.
Figure 8:
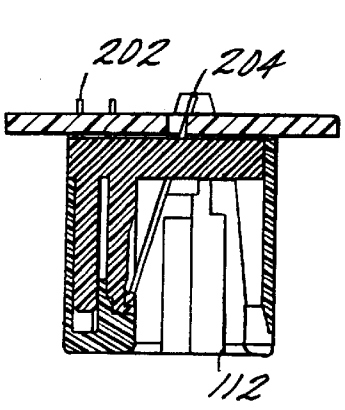
FIG. 8 is a cross sectional view taken along line 8—8 of FIG. 7.
Figure 7:
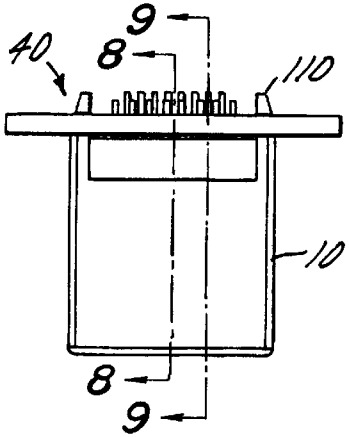
FIG. 7 is a top view of the switching jack mounted to a circuit board.
Figure 6:
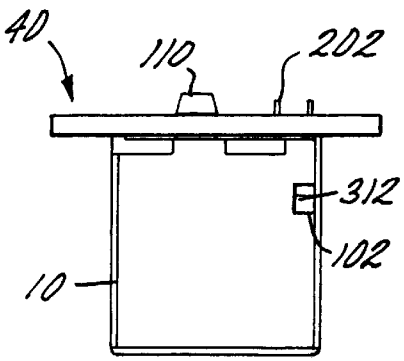
FIG. 6 is a left side view of the switching jack mounted to a circuit board.
Figure 12:
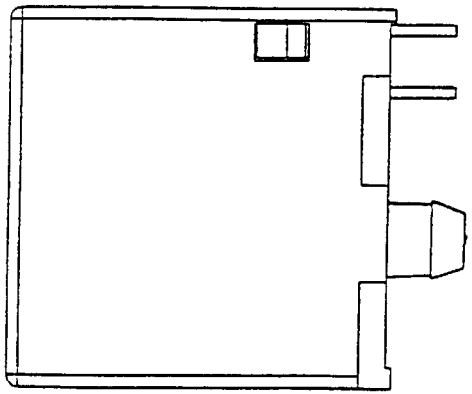
FIG. 12 is a right side view of the switching jack.
Figure 10:
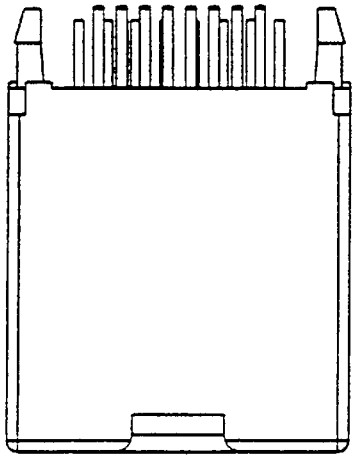
FIG. 10 is a top view of the switching jack.
Figure 11:
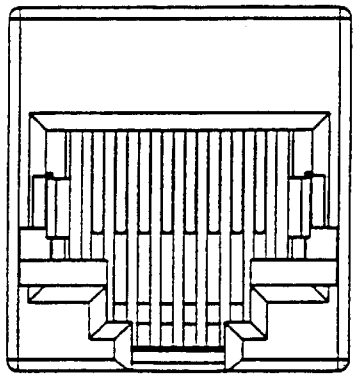
FIG. 11 is a front view of the switching jack.
Figure 14:
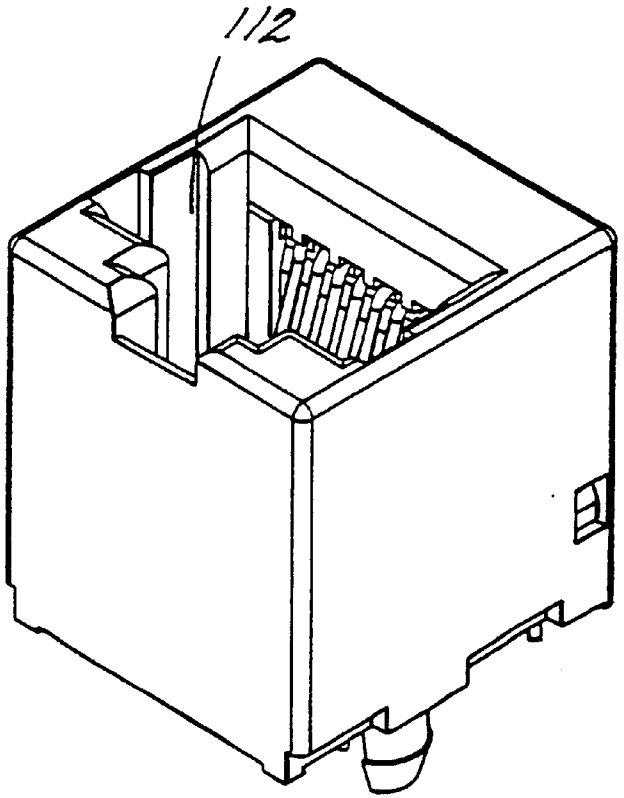
FIG. 14 is a perspective view of the switching jack with the front side up.
Figure 13:
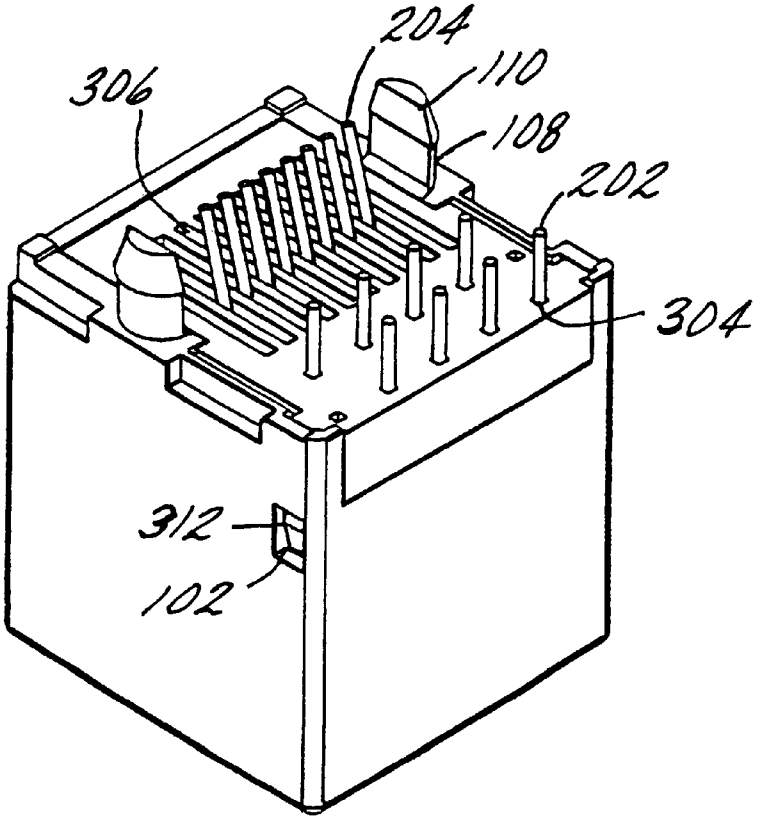
FIG. 13 is a perspective view of the switching jack with the rear side up.

FIG. 5 is a rear view of the switching jack mounted to the circuit board 40. The second end 204 of the conductive pins 20 contact the grooved contacts 408 formed in the aperture 406. FIG. 6 is a left side view of the switching jack connected to the circuit board 40. FIG. 7 is top view of the switching jack connected to the circuit board 40. FIG. 8 is a cross sectional view taken along line 8—8 in FIG. 7. FIG. 9 is a cross sectional view taken along line 9—9 of FIG. 7. As shown in FIGS. 8 and 9, the resilient conductive pins 20 extend angularly through an open area in the housing. When a plug is inserted in the opening 112 in housing 10, the second end 204 of the conductive pins 20 are flexed away from the contact grooves 408 in the aperture 406. When the plug is removed, the conductive pins 21 return to their original shape and the second ends 204 contact the groove contacts 408 in the aperture 406. FIG. 10 is a top view of the switching jack. FIG. 11 is a front view of the switching jack. FIG. 12 is a right side view of the switching jack. FIGS. 13 and 14 are perspective views of the switching jack.

Due to its reduced size, the single opening switching jack can be used in applications where the dual opening switching jacks of the prior art cannot be used. In addition, category 5 compliant patching applications can be designed by using two vertical switching jacks and a specific printed circuit board.

Figure 15:
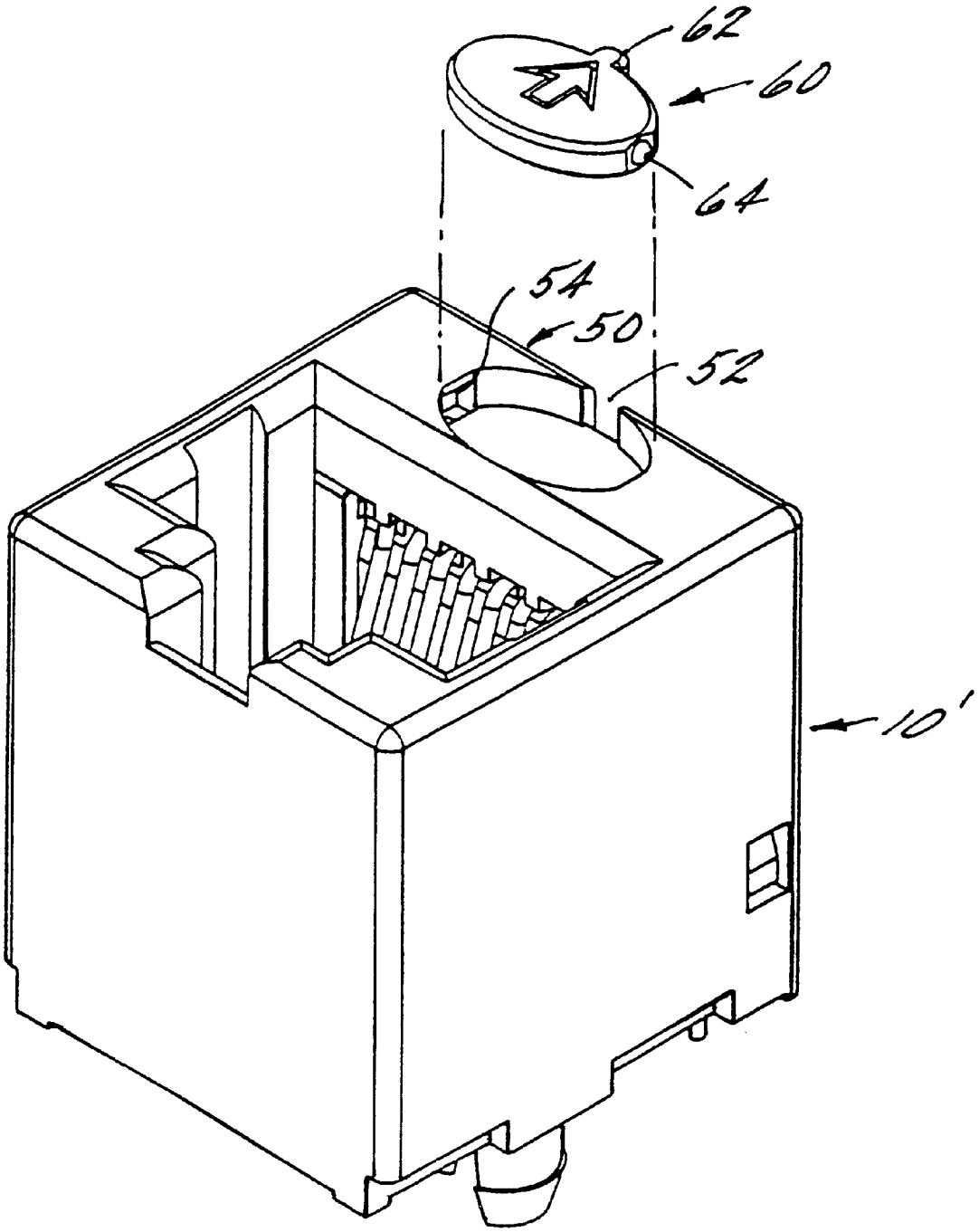
FIG. 15 is a perspective view of the switching jack including an icon.

FIG. 15 is a perspective view of an alternative housing 10'. The alternative housing 10' includes a pocket 50 for receiving an icon 60 which may be used for color coding or keying the jack. The icon 60 includes a projection 62 that is aligned with a notch 52 formed in the periphery of the pocket 50. The interaction between the projection 62 and the notch 52 ensure that the icon 60 is placed in the pocket 50 in the proper orientation. The icon 60 also includes a pair of bumps 64 that engage recess 54 formed in the interior wall of the pocket 50. The interference fit between the bumps 64 and the recesses 54 prevent the icon 60 from becoming dislodged from the housing 10'.

Figure 16:
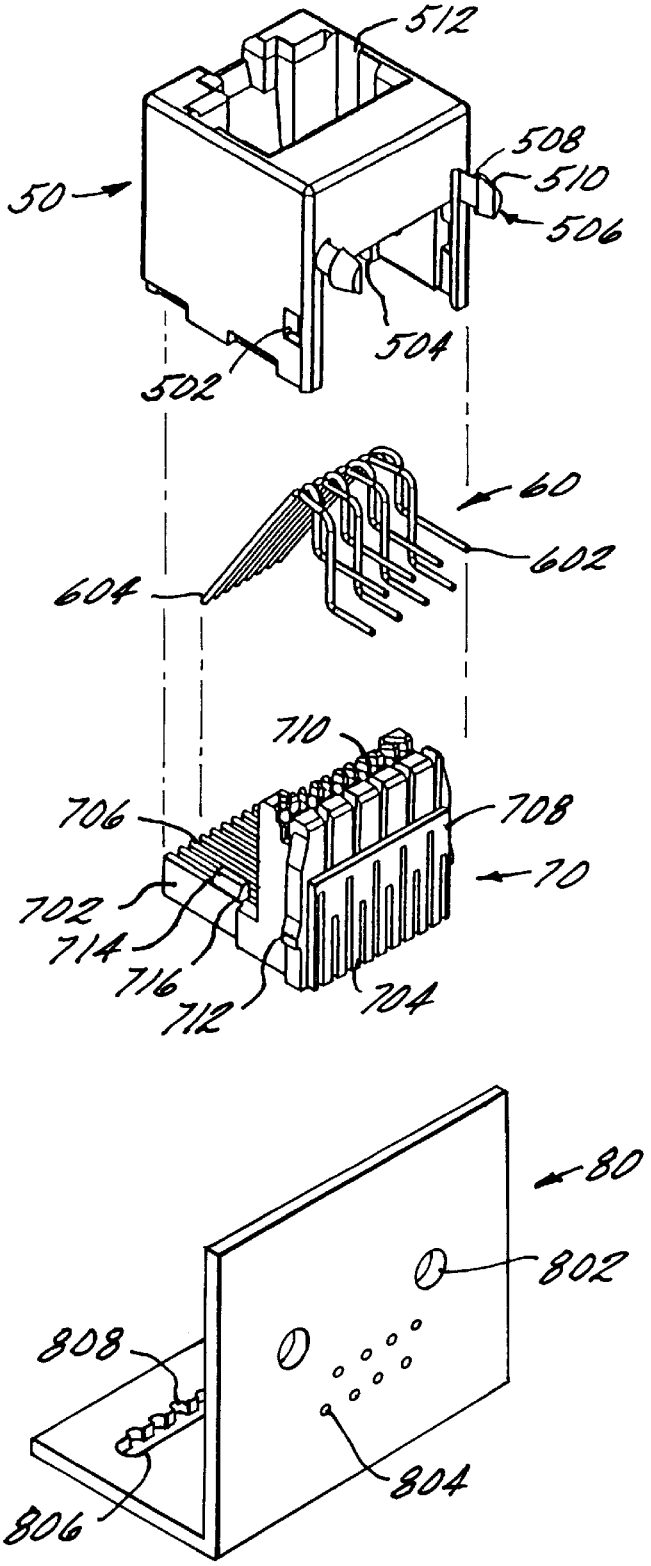
FIG. 16 is an exploded view of an alternative switching jack.

FIG. 16 is an exploded view of an alternative switching jack having an alternative housing opening location. The alternative switching jack is made up of a housing 50, resilient conductive pins 60 and a contact carrier 70. To assemble the switching jack, the conductive pins 60 are first mounted to the contact carrier 70. The rear section 702 of the contact carrier 70 includes a plurality of slots 706 shown in FIG. 16. The rear section 702 forms the rear face of the switching jack when connected to the housing. A plurality of openings 704 are formed in a bottom section 708. A first end 602 of each of the conductive pins 70 extends through the openings 704 in the contact carrier 70. A second end 604 of each of the conductive pins 60 extends through the slots 706. A bottom section 708 of the contact carrier 70 includes a front lip having a plurality of notches 710 for receiving a portion of the conductive pins 60. The notches 710 keep the conductive pins 60 separated and maintain the proper separation between the individual conductive pins 60. Although eight conductive pins 60 are shown in FIG. 16, it is understood that pin configurations such as two, four, six, and ten may be used in the switching jack.

Once the conductive pins 60 are mounted to the contact carrier 70, the housing 50 is then snapped on to the contact carrier 70. In an exemplary embodiment, both the contact carrier 70 and the housing 50 are made from a resilient plastic which allows the contact carrier 70 to be connected to the housing 50 without damage to the housing or contact carrier. A pair of tabs 712 formed on the periphery of the bottom section 708 of the contact carrier 70 engage a pair of slots 502 formed in side walls of the housing 50. In addition, two fingers 714, having a recess 716, engage two ribs 504 formed on the inside of the side walls of the housing 50. The ribs 504 are positioned with the recesses 716. The interference fit between the ribs 504 and the recesses 716 and the tabs 712 and slots 502 connect the contact carrier 70 to the housing 50. The assembled housing 50, conductive pins 60 and contact carrier 70 forms the switching jack.

The switching jack is then mounted to a circuit board 80 to form a patching module for performing various operations depending on the specifics of the circuit board 80. The circuit board 80 is a right angle circuit board or a flexible circuit board capable of contacting both ends of the conductive pins 60. The housing 50 includes a pair of tabs 506 having a neck 508 and a head 510 having a half conical shape. The neck 506 has an outer dimension that is smaller than the base of the head 510. The circuit board 80 includes holes 802 for receiving the tabs 506. The lip between the head 510 and the neck 508 engages the circuit board 80. The interference fit between the head 510 and the circuit board 80 connects the switching jack to the circuit board. The circuit board 80 includes holes 804 that receive the first end 602 of the conductive pins 60. The first end 602 of the conductive pins 60 is permanently attached to the circuit board 80 by soldering. An elongated aperture 806 is formed in the circuit board 80. Within the aperture 806 are contact grooves 808 that receive the second end 604 of the conductive pins. The contact between the second end 604 of the conductive pins 60 and the contact grooves 808 is broken when a plug is inserted in an opening 512 formed in the housing 50. The opening 512 is substantially perpendicular to the surface of the contact carrier 70 that the first ends 602 extend through.

Figure 18:
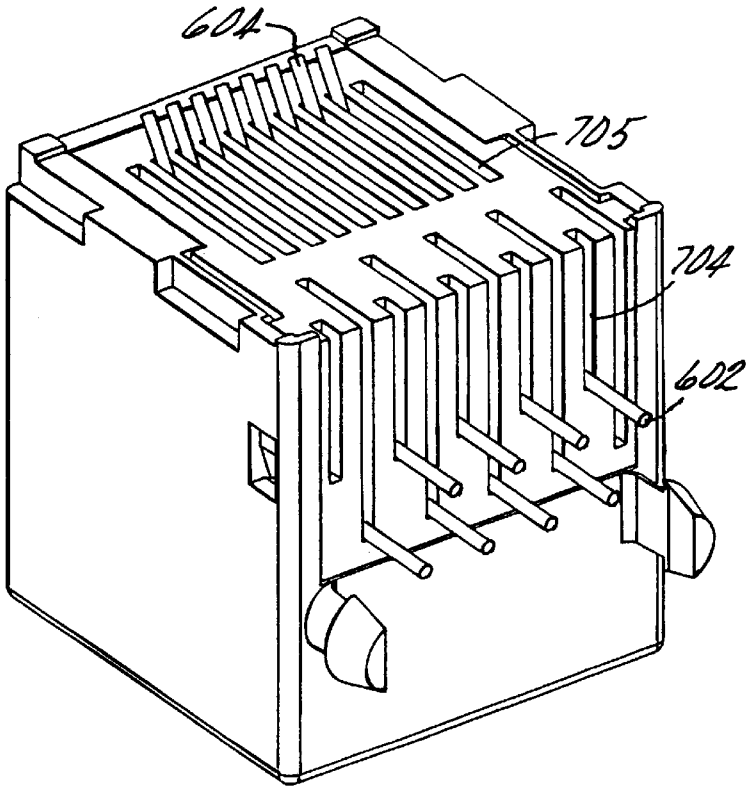
FIG. 18 is a perspective view of the switching jack of FIG. 16.
Figure 17:
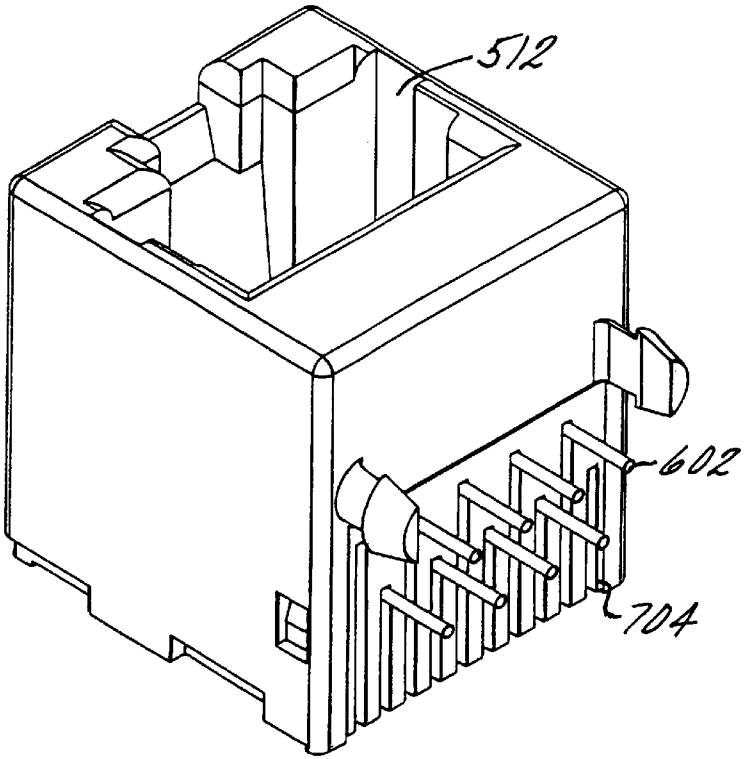
FIG. 17 is a perspective view of the switching jack of FIG. 16.

FIGS. 17 and 18 are perspective views of the alternative switching jack. As described above with reference to FIGS. 8 and 9, the resilient conductive pins 60 extend angularly through an open area in the housing 50. When a plug is inserted in the housing 50, the plug presses against the resilient conductive pins 60 and forces the second end 604 out of contact with the contact grooves 808 formed in circuit board 80.

The single opening switching jack of the present invention provides advantages over the prior art. The compact size of the single opening switching jack allows it to be used in applications where larger, dual-opening switching jacks cannot be used. In addition, the inclusion of an icon holder in the switching jack housing provides for color coding or keying of individual switching jacks.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A switching jack comprising:

a housing having a single opening for receiving a plug;

a plurality of resilient conductive pins having a first end and a second end, said plurality of resilient conductive pins extending through an open area in said housing such that said second end of said resilient conductive pins moves when the plug is inserted in said housing; and a contact carrier for receiving said resilient conductive pins and engaging said housing, said contact carrier having a rear section and a bottom section substantially perpendicular said rear section, said rear section being integrally formed with to said bottom section, said first end of said resilient conductive pins extending through holes in said rear section and said second end of said resilient conductive pins extending through slots in said rear section;

wherein said first end of said resilient conductive pins extends beyond said rear section a distance sufficient to enable said first end to make electrical contact with a circuit board; and wherein when a plug is not inserted in said housing, said second end of said resilient conductive pins extends beyond said rear section a distance sufficient to enable said second end to make electrical contact with the circuit board.

2. The switching jack of claim 1 wherein said housing further comprises at least one slot formed therein and said contact carrier further comprises at least one tab for engaging said slot when said contact carrier is coupled to said housing.

3. The switching jack of claim 1 wherein said contact carrier further comprises at least one finger including a recess formed in the finger and said housing further comprises a rib for engaging said recess formed in said finger when said contact carrier is coupled to said housing.

4. The switching jack of claim 1 wherein said opening is parallel to said rear surface.

5. The switching jack of claim 1 further comprising tabs extending from said housing for securing said housing to the circuit board.

* * * * *